United States Patent [19]

Lütz

[11] 4,284,058

[45] Aug. 18, 1981

[54] BACKPACKER'S STOVE APPARATUS

[75] Inventor: William R. Lütz, Chamblee, Ga.

[73] Assignee: Conceptual Factors, Inc., Atlanta, Ga.

[21] Appl. No.: 45,131

[22] Filed: Jun. 4, 1979

[51] Int. Cl.[3] ..... F24C 1/16

[52] U.S. Cl. ..... 126/9 R; 126/38; 126/39 B

[58] Field of Search ..... 126/9 R, 9 A, 9 C, 38, 126/39 R, 39 B; 431/344; 222/5

[56] References Cited

U.S. PATENT DOCUMENTS

| | | | |
|---|---|---|---|
| 2,825,325 | 3/1958 | Ross | 431/344 |
| 3,156,379 | 11/1964 | Corlet | 431/344 |
| 4,192,284 | 3/1980 | Vache | 126/38 |

*Primary Examiner*—Carroll B. Dority, Jr.
*Attorney, Agent, or Firm*—Louis T. Isaf

[57] ABSTRACT

A stove apparatus comprising a valve-burner assembly and a fuel container threaded together in direct connection, and a collapsable pot stand assembly which includes a windscreen for protecting the flame of the burner. The pot stand assembly, valve-burner assembly and fuel container fit for compact packaging within the pans used for cooking.

13 Claims, 4 Drawing Figures

BACKPACKER'S STOVE APPARATUS

FIELD OF INVENTION

The present invention relates generally to the field of portable stoves and more specifically to lightweight, gas operated, foldable backpacker's stoves.

BACKGROUND OF THE INVENTION

The aim of the backpacker usually is to carry more items, yet to have his load weigh less. Therefore, items which are compact and lightweight usually are sought over those that are heavier. To this end, numerous lightweight portable stoves have been designed specifically with the backpacker in mind which utilize either liquid fuels or gaseous fuels.

In cold temperatures, liquid fuels typically require preheating before they can be lighted for cooking in the stove. The preheating is accomplished in various ways including the use of "fire ribbon" used to heat the fuel outlet to vaporize the fuel. Vaporization of liquid fuels at high altitudes at times requires pumping of the fuel canisters to increase the pressure, as well as preheating. Another disadvantage of liquid fuels is that liquids are relatively heavy and add unnecessary weight to the backpacker's pack.

Prior art portable outdoor stoves are often top heavy and unstable, especially when loaded with pots of food. Such stoves are too tall, having too great a height to base-width ratio. This appears to be especially true of stoves utilizing gaseous fuels. Gaseous fuels, such as propane or butane, generally are contained within pressurized containers which customarily are tall and cylindrical in shape. Rather than alter the customary shape of the container, designers and manufacturers of portable outdoor stoves appear to have designed their stoves around the container. Therefore, compactness and stability of prior art portable stoves seem to be incompatible.

Backpacker stoves utilizing pressurized gas containers, especially butane containers, typically have utilized a brace or strap device across the bottom of the container to hold the container in place against the base of the pot stand assembly. The valve assembly attaches directly to the base, for example, by threading, and a needle of the valve assembly punctures and container to release gas into the valve assembly. There usually is no positive, direct attachment between the valve assembly and the fuel container and, therefore, if the brace or strap device slips, the container can drop free of the valve and ignite. Typically, once the valve has engaged the fuel container and the needle has punctured the container, the fuel container cannot be removed until the fuel is completely expended. This interferes with any disassembly of the stove to repack the stove in a compact arrangement.

Foldable pan supports of most prior art stoves, especially stoves with gaseous fuels, are made from heavy gauge wire and include framework type supports. The heavy wire supports often are not self-locking in their operational mode and require the added weight of a cooking pan to hold them in that mode. Generally there is no windscreen or the windscreen is separate from the pan support.

SUMMARY OF THE INVENTION

Briefly described, the present invention comprises a stove apparatus including a valve/burner assembly and a fuel container threaded together in direct connection, and a pot stand assembly which includes a windscreen for protecting the flame of the burner. In the preferred embodiment, the stove base and the fuel container are constructed to provide stable support for the pot stand assembly even when full pots are carried on the pot stand. The pot stand assembly is foldable for compact packaging within the same pans which are used for cooking.

The stove apparatus of the present invention is of special advantage and interest to backpackers in that the present invention lends itself to being made of lightweight material, while at the same time retaining strength and durability. The stove apparatus is small and is foldable into a very compact package for easy carrying within a backpack. The unique fuel container, the interplay between the construction of the fuel container and the pot stand assembly, and the positive connection between the fuel container and valve assembly all combine to make the stove apparatus of the present invention compact, stable and safe.

The base member of the pot stand assembly is very lightweight, wasting as little material as possible in its design. The pot stand assembly maintains a low center of gravity to give the stove apparatus stability. The pot supporting members, called wing plates, are rigid yet very lightweight; they provide support for pots and pans and also a windscreen to protect the stove flame. Preferably, the wing plates are pivotable between a cooking position and a compact, packed position. When in the cooking position, the wing plates are interlocked by cooperating tabs in such a manner that an increase in the weight of a pan makes the pot stand even stronger and sturdier.

The fuel container is removable and preferably disposable. In the preferred embodiment, the fuel container is so shaped as to fit completely within the base of the pot stand assembly. Preferably, butane fuel is used in the present invention since butane has a lower vaporizing temperature than, for example, white gas, and is therefore easier to ignite in cold weather. The butane container of the preferred embodiment is small enough to fit within a coat pocket of the backpacker in order that the container can be kept warm, thus further enhancing proper operation of the stove apparatus in cold weather. The fuel container is capable of being resealed, and, to that end, is provided with a resealing plug in order that the container can be removed from the stove unit after it has been only partially used and can be resealed and carried in the coat pocket.

The valve assembly extends through the base member and is threaded directly into the fuel container which rests underneath the base member, to further enhance the strength and stability of the platform. The direct connection between the valve assembly and fuel container protects against accidental gas leaks by preventing unintentional separation of the valve assembly from the fuel container. Furthermore, the need for bracing and like support for the fuel container is eliminated.

Two pans are included in the present invention which have a relatively large bottom surface area to cut down on the time needed to heat a meal. The pans also serve as the package, one pan covering the other, into which the rest of the stove apparatus is packed. The wing plates of the stove apparatus fold down, and the pot stand assembly, valve assembly and fuel container all fit within the two pans. There is no need to disconnect the fuel container during packaging, although it may be done.

Therefore, it is an object of the present invention to provide an improved, small, lightweight portable stove apparatus for campers and backpackers.

Another object of the present invention is to provide a strong and stable portable stove apparatus.

Another object of the present invention is to provide a portable backpacker's stove apparatus which includes a uniquely designed fuel container with direct, positive connection between the fuel container and the valve/-burner assembly.

Still another object of the present invention is to provide a backpacker's stove apparatus with a removable pocket-size fuel container.

Another object of the present invention is to provide a backpacker's stove apparatus with a foldable windscreen for protecting the burner flame.

Another object of the invention is to provide a durable, inexpensive, lightweight portable stove apparatus which can be folded and arranged in a compact storage configuration for carrying by a backpacker and which can be expediently unfolded and set up for reliable use at a camp site.

Other objects, features and advantages of the present invention will become apparent upon reading the following specification, when taken in conjunction with the accompanying drawings.

DETAILED DESCRIPTION

Figure 1:
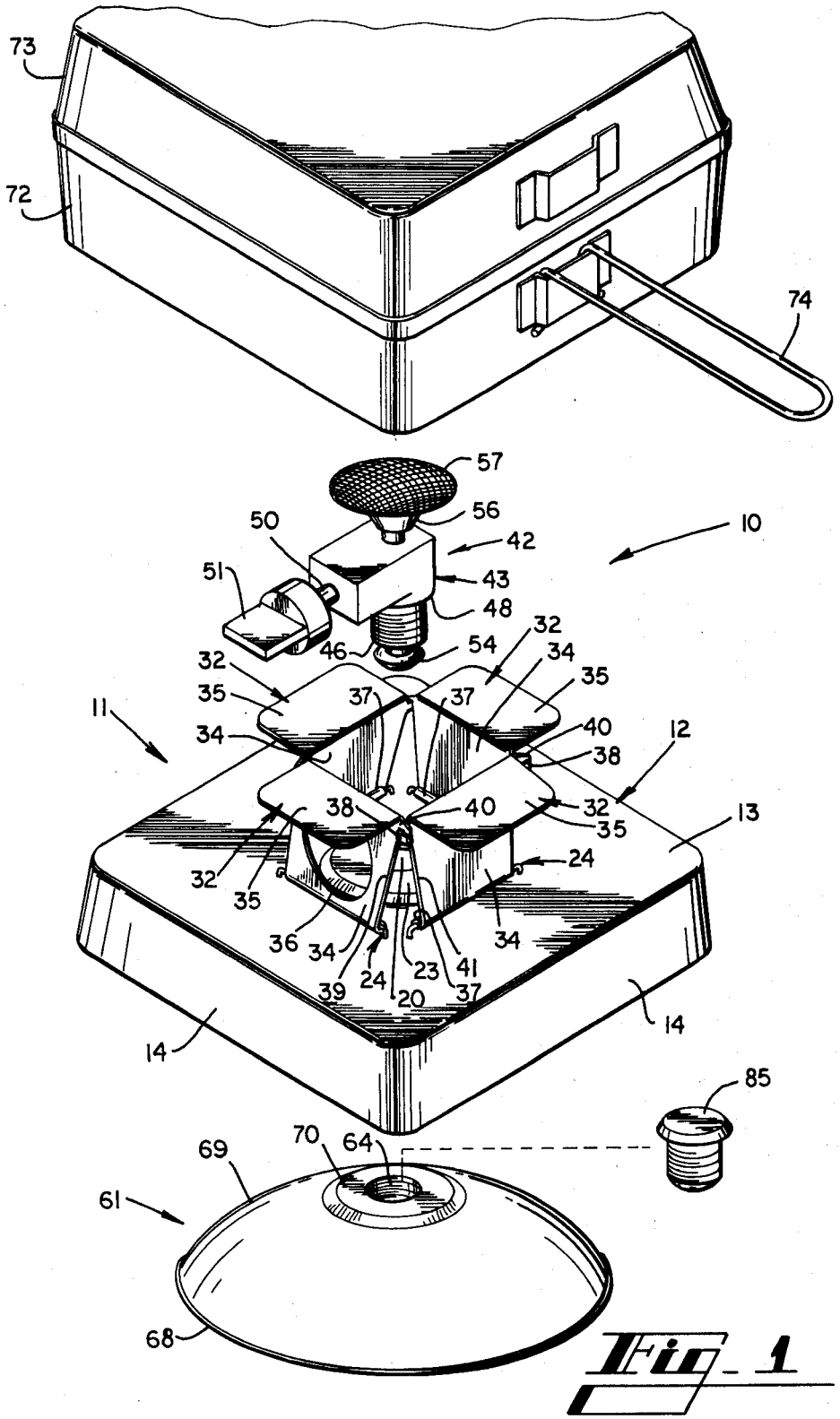
FIG. 1 is a perspective view of the stove apparatus of the present invention in the cooking position, with parts exploded apart for clarity.
Figure 2:
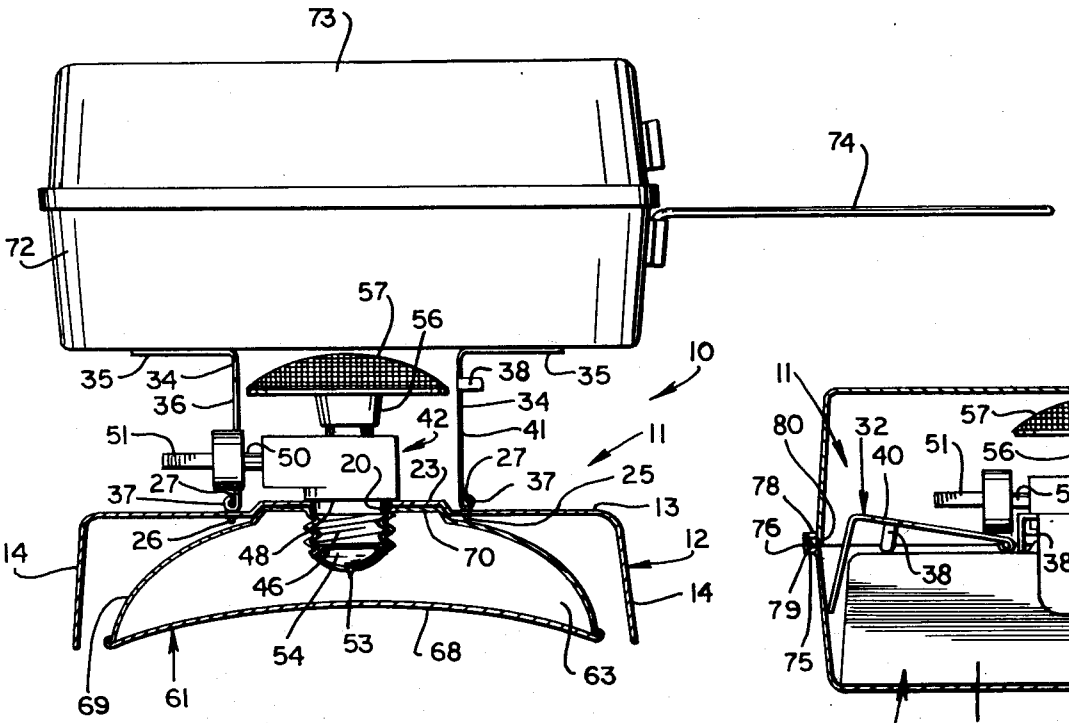
FIG. 2 is a side view of the stove apparatus of FIG. 1 in the cooking position, with parts shown in cross section for clarity.

Referring now in greater detail to the drawings in which like numerals represent like components throughout the several views, FIGS. 1 and 2 show the backpacker's stove apparatus 10 of the present invention in its "cooking" position. The stove apparatus 10 comprises a pot stand assembly 11 including a base member 12 which, in the preferred embodiments depicted in the drawings, includes a generally square, generally flat, top plate or base plate 13 and four side walls 14 protruding downwardly from the top plate to form rigid skirt. An opening 20 is formed in the center of the top plate 13. The top plate 13 includes a raised boss portion 23 surrounding the central portion of the top plate through which the opening 20 is formed. In the preferred embodiment, the base member 12 of the stove apparatus 10 includes a top plate 13 the width of which is greater than or equal to twice the height of the side walls 14 and the top plate 13 and side walls 14 define between them on open pocket. The width of the top plate 13 defines width dimension of the base member 12 and the height of the side walls defines the height dimension of the base member.

Four hinge pins 24 are attached to the top plate 13 on four sides of the boss 23 and opening 20, each hinge pin 24 being at right angles to the adjacent hinge pins and parallel to its adjacent skirt 14. Each hinge pin 24 of the disclosed embodiment comprises a bent wire element 24, the two ends 25, 26 of which protrude through the top plate 13 and make contact with the bottom side of the top plate 13 (FIG. 2). Between the two ends 25, 26 the wire element 24 is bent to form a flat loop 27 protruding above the top plate 13.

The pot stand assembly 12 further includes four wing plates 32 each attached to a flat loop 27 of each of the four hinge pins 24 above the top plate 13. Each wing plate 32 includes two flat planar sections 34, 35 arranged perpendicular to one another. Preferably, the two planar sections 34, 35 are formed of one continuous sheet of material although the invention is not to be limited thereby. One edge 37 of the wing plate 32, being the lower edge of planar section 34 opposite planar section 35, is pivotably attached to the hinge pin 24 by wrapping the lower edge 37 of section 34 around the flat loop 27 of the pin 24. The wing plates 32 each pivot about a hinge pin 24 relative to the top plate 13 of the base member 12.

A short, narrow, rectangular tab 38 protrudes rigidly from one side edge 39 of planar section 34 of each wing plate 32. A short L-shaped tab 40 protrudes outward and down from one side edge 41 of the planar section 34 of each wing plate 32. The L-shaped tab 40 protrudes from just one side edge 41 being that edge opposite the side edge 39 from which the rectangular tab 38 protrudes, and the L-shaped tab 40 occupies the same plane as the lower planar section 34. The rectangular tab 38 and L-shaped tab 40 are located at approximately the same relative distance along the respective edges 39, 41 from the lower edge 37 of the wing plate 32. The rectangular tab 38 protrudes from the planar section 34 at approximately a right angle from the plane of that section 34 and the L-shaped tab 40 protrudes from planar sections 34 parallel to the plane of that section 34. An opening 36 is defined in planar section 34 of one of the wing plates 32.

The stove apparatus 10 of the present invention also comprises a valve and burner assembly 42 including a generally cylindrical valve stem 43 which includes a passage axially through the stem 43 with openings (not shown) at each end. The lower threaded portion 46, of the valve stem 43 includes external threading. An annular flange 48 is formed about the valve stem 43 immediately above the threaded portion 46. A valve control pin 50 extends into the valve stem 43 to communicate with the passage within the valve for selectively opening and closing the passage. A regulator knob 51 is attached to the outer end of the control pin 50. A needle 53 (FIG. 2) extends axially from the lower end of the valve stem 43 and a sealing gasket 54 is mounted adjacent the lower end of the stem. A flame spreader 56 is mounted to the top of the valve stem 43 in communication with an opening (not shown) at the upper end of the passage (not shown) which extends axially through the stem 43. A wire mesh 57 covers over the flame spreader 56.

The stove apparatus further comprises a fuel container or canister 61 which defines a hollow cavity 63 therein and a valve accepting recess 64 formed in the body. The valve accepting recess 64 includes internal threading. In the preferred embodiment, the fuel container 60 includes a symmetrical, generally dome-shaped top wall 69 connected at its periphery to a circular, concave bottom wall 68. The top wall or cover portion 69 is convex and includes a raised portion 70 at its center which corresponds in size and shape to the boss 23 of base member 12. The valve accepting recess 64 is formed in the center of the cover portion 69 at the raised portion 70. The fuel container 61 is pressurized with fuel and the fuel held within the container is preferably butane gas. The dimensions of the container 61, in the preferred embodiment, are such that the container fits completely within the pocket defined in the base member 12 under the top plate 13 and between the side walls 14. Therefore, the overall height, or largest height dimension, of the container 61 is preferably less than the height of the side walls 14 and the greatest diameter, or largest width dimension, of the container is preferably less than both the width and the length of the top plate 13.

Figure 3:
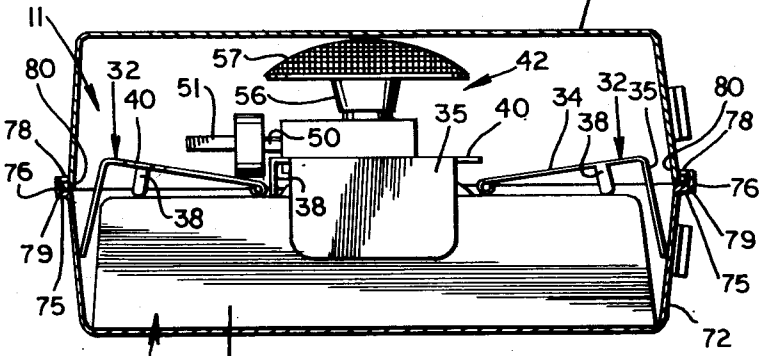
FIG. 3 is a side view of the stove apparatus of FIG. 1 in the packaged position, with parts shown in cross section for clarity.

Two cooking pans 72, 73 are included in the stove apparatus (see FIGS. 1, 2 and 3). The pans 72, 73 are both of a shape similar to the base member 12, that is, in the preferred embodiment, rectangular. One pan 72, hereinafter referred to as bottom pan, is large enough in width and length to accept the base member 13 therein (see FIG. 3). The bottom pan 72 includes a ledge 75 along its upper rim and a raised annular lip 76 about the outer edge of the ledge. The annular lip 76 includes inwardly protruding knobs 78 on two opposite sides of the bottom pan 72. Pan 73, the top pan, includes an outwardly protruding knob 79 at the rim 80 of two opposite sides of the pan. Each pan 72, 73 is provided with a removably attachable handle 74.

A specific embodiment of the preferred embodiment of the present invention includes a base member 12 with an approximately five and one-half inch square top plate 13 and one and one-half inch high side walls 14. The planar section 34 of the wing plates 32 are approximately one and three-quarter inches tall with an average width of approximately two inches. The valve assembly 42, when mounted in place, stands with the wire mesh 57 approximately one and one-quarter inches above the top plate 13. The fuel canister 61 has approximately a five inch base diameter and a one and three-eights inch overall height. The bottom pan 72 is approximately six and one-eighth inches square at the annular lip 76 and one and three-quarter inches high. The top pan 73 is approximately six inches square at its rim 80 and one and one-half inches high.

ASSEMBLY AND OPERATION

The stove apparatus 10 of the present invention is assembled for cooking as follows: The base member 12 is placed over the top of the butane fuel container 61 with the recess 64 of the container in alignment with the opening 20 in the base plate and the raised boss portion 23 of the base member matched up with the raised portion 70 of the fuel container 61. The two raised portions 23, 70 function as alignment guides.

The lower, threaded portion 46 of the valve stem 43 of the valve and burner assembly 42 is extended from above the base plate 13 through the opening 20 and into engagement with the valve accepting recess 64 of the fuel container 61. The valve stem 43 is threaded into the recess 64 and draws together the fuel container 61 and annular flange 48 of the valve assembly 42 until the flange rests on top of the base plate 13 to pinch the base plate tightly between the flange and the fuel container cover portion 69. Preferably, in this position, the fuel container 61 is drawn completely up into the base member 12 such that the bottom 68 of the container does not extend below the side walls 14 of the base member. Furthermore, as the valve stem 43 is threaded into the recess 64, the needle 53 at the end of the valve stem punctures a hole in the fuel container 61 at the bottom of the recess 64. The sealing gasket 54 prevents escape of gas from about the periphery of the valve stem 43 and thus escaping gas is directed through the passage (not shown) formed axially through the valve stem. The control pin 50 and regulator knob 51 control the flow of gases through the valve stem passage.

The wing plates 32 are pivoted about their respective hinge pin 24 to their up or "cooking" position in which planar section 34 is oriented approximately perpendicular to the base plate 13. Planar sections 34 function as support legs 34 for the planar sections 35 which in turn function as pot engaging and supporting surfaces 35. The support legs 34 extend slightly higher than the top of the wire mesh 57 of the valve and burner assembly 42 and the pot engaging surfaces 35 extend outwardly, relative to the valve and burner assembly, approximately parallel to the base plate 13.

The wing plates 32 are retained in the "cooking" position by interlocking adjacent wing plates. With the wing plates 32 pivoted up, the rectangular tab 38 of each wing plate contacts the "L" shaped tab 40 of an adjacent wing plate. The rectangular tabs 38 angle outward at right angles to the plane of the support legs 34 and the "L" shaped tabs 40, which now extend parallel to the respective rectangular tabs 38 with which they make contact, are hooked over the respective adjacent rectangular tabs 38 (FIG. 1). The regulator knob 51 is aligned with and protrudes through the opening 36 which is defined in the support leg 34 of only one of the wing plates 32.

In use, the control pin 50 is manipulated by the regulator knob 51 to permit gas to flow from the fuel container 61 through the passage (not shown) in the valve stem 43 of the valve and burner assembly 42 and out the valve stem adjacent the flame spreader 56. The flame spreader 56 acting as a burner, is lighted and the resulting flame is diffused over a fairly wide area by the flame spreader 56 and wire mesh 57. The regulator knob 51, which is accessible through the opening 36 in the wing plate 32, and the control pin 50 are used to control the amount of gas fed to the flame. The support legs 34 function as windscreens to protect the burner from gusts of wind that might extinguish the flame.

The two pans 72, 73 are used in various combinations as cooking pans supported above the flame by the pot (pan) engaging surfaces 35 of the wing plates 32 cooperatively functioning as pot supports.

The butane canister 61 is disposable and is easily removed and replaced by unscrewing the threaded portion 46 of the valve stem 43 from the canister recess 64. The depicted shape of the canister 61 is the preferred embodiment, however, any shape canister which fits within the base member 12, is directly connectable to the valve assembly 42 and can hold gas under pressure is contemplated by this invention.

The valve assembly 42 and the butane container 61 are in positive connection with one another, for example, they are threaded together. In the preferred embodiments, the valve assembly 42 and fuel container 61 are not attached or otherwise connected to the pot stand assembly 11 except by the pinching action described above between the valve flange 48 and the canister cover portion 69.

The stove apparatus 10 of the present invention is packaged for carrying in a backpack or otherwise, with reference to FIG. 3, as follows: The pans 72, 73 are removed from on top of the pot stand assembly 11. The interlock between the tabs 38, 40 of the wing plates 32 is disconnected and each wing plate is pivoted about the respective hinge pin 24 to a down or "packing" position in which the support leg section 34 is adjacent the base plate 13 and the pot engaging surface 35 extends down beside the base member 12 adjacent the respective side wall 14. The pot stand assembly 11, the butane container 61 still held within the base member 12 by the valve assembly 42, and the valve assembly 42 are placed inside the bottom pan 72. The top pan 73 is then placed over the packed unit with the rim 80 of the top pan resting on the ledge 75 of the bottom pan 72. Outwardly protruding knobs 79 along the rim 80 of the top pan snap under the inwardly protruding knobs 78 on the annular lip 76 of the bottom pan to hold the two pans together. There is added room within the package for holding the pan handles 74, and cooking utensils and other small objects within the pans.

In the preferred embodiment, the wing plates must be pivoted to the down position in order to be packed in the pans 72, 73. However, in alternate embodiments, the wing plates 32 are retained in the up position, either permanently or pivotably, in which case the valve assembly 42 and support legs 34 are short enough that they fit within the two pans.

The fuel container 61 is removable from the valve stem 43 and can be carried separately from the packaged unit. When the fuel container 61 is carried separately, a plug device 85 (see FIG. 1) is inserted, by threading or otherwise, into the bore 42 of the container to create a seal over the bore and prevent loss of fuel from the container.

Figure 4:
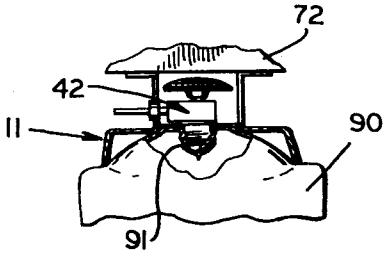
FIG. 4 is a detail side view of the stove apparatus in the cooking position, but showing a second embodiment thereof, with parts shown in cross section for clarity.

In a second embodiment, seen in FIG. 4, the pot stand assembly 11 rests on top of a fuel container 90. The container 90 protrudes up into the base member 12 and includes an internally threaded bore 91 for direct connection with the valve and burner assembly 42. It is within the scope of this invention, in view of the embodiment of FIG. 4, to shorten or even eliminate the side walls 14 of the base member 12 and rest the top plate 13 on the fuel container 61. The valve stem 43 extends through the opening 20 of the top plate 13 and is threaded into, or otherwise directly connected to the fuel container 61.

While this invention has been described in detail with particular reference to preferred embodiments thereof, it will be understood that variations and modifications can be effected within the spirit and scope of the invention as described hereinbefore and as defined in the appended claims.

I claim:

1. A backpacker's stove apparatus comprising:

a base including an upper surface and an opening defined in said upper surface;

a fuel canister removably positioned beneath said base;

a valve and burner means protruding above said base and extending through said opening of said base to connect to said fuel canister beneath said base for selectively releasing fuel from said fuel canister;

a foldable pot support mounted on top of said base, said pot support including a plurality of wing plates pivotably attached to the top surface of said base, each said wing plate including a first planar section pivotably attached at one of its edges to said upper surface of said base and being pivotable relative to said upper surface between a down position and an up position, each said wing plate further including a second pot engaging portion extending approximately perpendicular to said first planar section, whereby said wing plates in said up position form a windscreen about said valve and burner means and a pot support to hold a pot above said valve and burner means, and said wing plates are pivotable to said down position for packaging and storage.

2. Stove apparatus of claim 1, wherein said pot support further includes locking means associated with said plurality of wing plates for locking said wing plates in said up position.

3. Stove apparatus of claim 2, wherein said locking means comprises tab means for interlocking adjacent wing plates in said up position, said tab means including a first tab extending from said planar section of a first wing plate and a second tab extending from said planar section of a second wing plate adjacent said first wing plate, said second tab defining a hook means for interlocking with said first tab of said first wing plate.

4. Stove apparatus of claim 1, wherein said fuel canister includes a valve-accepting opening aligned with said opening in said upper surface of said base, said valve-accepting opening including internal threading.

5. Stove apparatus of claim 4, wherein said valve and burner means comprises:

a threaded stem portion including external threading, said threaded stem portion extending through said opening in said upper surface of said base and being removably threaded into said valve accepting opening of said fuel canister; and a flange portion engaging said upper surface of said base, said canister releasably contacting said base from beneath and said flange portion releasably contacting said base from above, whereby said base is pinched tightly between said canister and said flange portion.

6. Stove apparatus of claim 1, wherein said base comprises:

a generally flat top plate including said upper surface;

an opening defined in said top plate including said opening defined in said upper surface;

side walls protruding from the edges of said top plate, said base being open at its bottom side, said side walls and top plate defining a pocket into which said fuel canister is inserted.

7. Stove apparatus of claim 6, wherein said base includes a width dimension and a height dimension less than or equal to one half said width dimension.

8. Stove apparatus of claim 6 or 7, wherein said fuel canister is completely contained within said pocket defined by said top plate and said side walls of said base.

9. Stove apparatus of claim 1, further comprising a top cover and a bottom cover into which said base, said fuel canister, said valve and burner means, and said pot support are packaged, said top cover and bottom cover each comprising a cooking pan.

10. Stove apparatus of claim 1, wherein said fuel canister comprises:

a generally dome shaped cover portion;

a circular bottom wall connected at its periphery to the periphery of said cover portion;

a valve accepting means defined in said cover portion for releasably holding a valve member attached to said fuel canister; and wherein the width of said fuel canister is at least twice the height of said fuel canister.

11. Stove apparatus of claim 10, wherein said valve accepting means comprises an inwardly protruding recess including internal threading.

12. Stove apparatus of claim 10, wherein said fuel canister is pressurized.

13. Stove apparatus of claim 10, further comprising butane gas contained under pressure within said fuel canister.

* * * * *